US006837406B2

(12) United States Patent
Sclafani

(10) Patent No.: US 6,837,406 B2
(45) Date of Patent: Jan. 4, 2005

(54) INFANT AND SMALL CHILD CARRIER

(76) Inventor: Christopher Sclafani, 122 E. 7th St., Beach Haven, NJ (US) 08008

( * ) Notice: Subject to any disclaimer, the term of this patent is extended or adjusted under 35 U.S.C. 154(b) by 120 days.

(21) Appl. No.: 10/068,527

(22) Filed: Feb. 8, 2002

(65) Prior Publication Data

US 2003/0150891 A1 Aug. 14, 2003

(51) Int. Cl.[7] ..... A61G 1/00
(52) U.S. Cl. ..... 224/159; 224/579; 224/580; 224/625
(58) Field of Search ..... 224/158, 159, 224/160, 161, 625, 626, 627, 628, 629, 579, 580, 154

(56) References Cited

U.S. PATENT DOCUMENTS 3,910,470 A * 10/1975 Swenson et al. ..... 224/610
4,458,834 A * 7/1984 Rosen ..... 224/160
4,901,898 A * 2/1990 Colombo et al. ..... 224/159
5,011,056 A * 4/1991 Larreategui ..... 224/159
5,205,450 A * 4/1993 Derosier ..... 224/161
5,441,186 A * 8/1995 Halligan ..... 224/159
5,657,912 A * 8/1997 Nakayama ..... 224/159
5,711,466 A * 1/1998 Kataoka et al. ..... 224/159
6,471,105 B1 * 10/2002 Ammerman et al. ..... 224/625

* cited by examiner

*Primary Examiner*—Stephen K. Cronin
(74) *Attorney, Agent, or Firm*—Charles I. Brodsky

(57) ABSTRACT

The carrier essentially comprises a seat worn about one's waist having an upwardly extending upper section and a downwardly extending lower section which is rotated against the thigh in bearing the weight of an infant or small child placed upon the upper section and held in position only by the arm and hand of the wearer.

8 Claims, 6 Drawing Sheets

INFANT AND SMALL CHILD CARRIER

STATEMENT REGARDING FEDERALLY SPONSORED RESEARCH OR DEVELOPMENT

Research and development of this invention and Application have not been federally sponsored, and no rights are given under any Federal program.

CROSS-REFERENCE TO RELATED APPLICATIONS

None

REFERENCE TO A MICROFICHE APPENDIX

Not Applicable

BACKGROUND OF THE INVENTION

1. Field of the Invention

This invention relates to the carrying of infants and small children in a manner different from that primarily associated with conventional carriers and/or backpacks.

2. Description of the Related Art

As is well known and understood, with those infant and small child carriers commercially available, the child faces in towards the parent (as for extra closeness) or faces out to the front (so the child can view the world). Generally designed for children up to 35 lbs. in weight, these carriers oftentimes features such enhancements as ventilated foams for both parent and infant comfort, storage pockets, removable support pillows, padded-seats and removable canopies for protection against the weather. While sometimes configured for dual side entry as contrasted with being placed directly in front against the parent's chest, and sometimes with adjustable seats and/or straps, carriers of this type—whether machine washable or not—all suffer the disadvantage of having to fit the infant or child in to begin with, and to then strap the infant or child in position, which is not something simple and easy to do. As will also be understood, this disadvantage becomes all the more magnified when having to unstrap the infant or child—as to place it down to be diapered, for example—, and then having to pick it back up to be strapped into the carrier once again. And, for larger children where the conventional carrier is too small, placing the child in a backpack for carrying about makes the problem in unstrapping the child, taking it down, and then strapping it back in place for carrying even more complicated. For newborns where the carrying is frequently done in a cradle position, the "taking down" and then the "setting-up" again can easily take a few minutes to accomplish.

OBJECTS OF THE INVENTION

It is an object of the present invention, therefore, to provide a new and improved carrier for infant and small children.

It is also an object of the present invention to provide such a carrier which is exceedingly simple to use and easy for a parent to put on and take off.

It is another object of the invention to provide a carrier of this type capable of supporting the weight of infants and small children easily up to weights of 50 lbs. and more.

It is a further object of the invention to provide a carrier of this type which can be easily manufactured to enable retail sale at prices comparable to those at which newborn, infant and small child carriers and/or backpacks are presently being sold at.

SUMMARY OF THE INVENTION

As will become clear from the following description, the infant and small child carrier of the present invention is in the nature of a plastic, or other hard material, seat worn against the thigh of the parent, and secured in position by a belt which encircles the waist and a strap which buckles from the waist across the chest, over the shoulder, and down the back. As will also become clear, the seat includes an upper section on which the infant or child sits (which is downwardly sloped towards the parent), and a lower section which rests against the thigh of the parent (but which downwardly slopes away), with the join between the upper and lower sections serving as a fulcrum or pivot point adjacent the waist. With the lower section preferably of a greater length in extending downwardly along the thigh, the weight of the infant or child will be appreciated as being in a direction to lever the lower section inwardly, in enabling the hip to thereby support the weight to be carried. With the parent's arm restraining the infant or child on the upper section—either left or right depending upon which thigh the carrier is bearing against—and without the infant or child being strapped in, the carrier of the invention will be understood to essentially comprise a "hip seat", rather than the conventional infant or child carrier which straddles about the neck in wearing.

BRIEF DESCRIPTION OF THE DRAWINGS

These and other features of the present invention will be more clearly understood from a consideration of the following description, taken in connection with the accompanying drawings, in which.

DETAILED DESCRIPTION OF THE INVENTION

Figure 5:
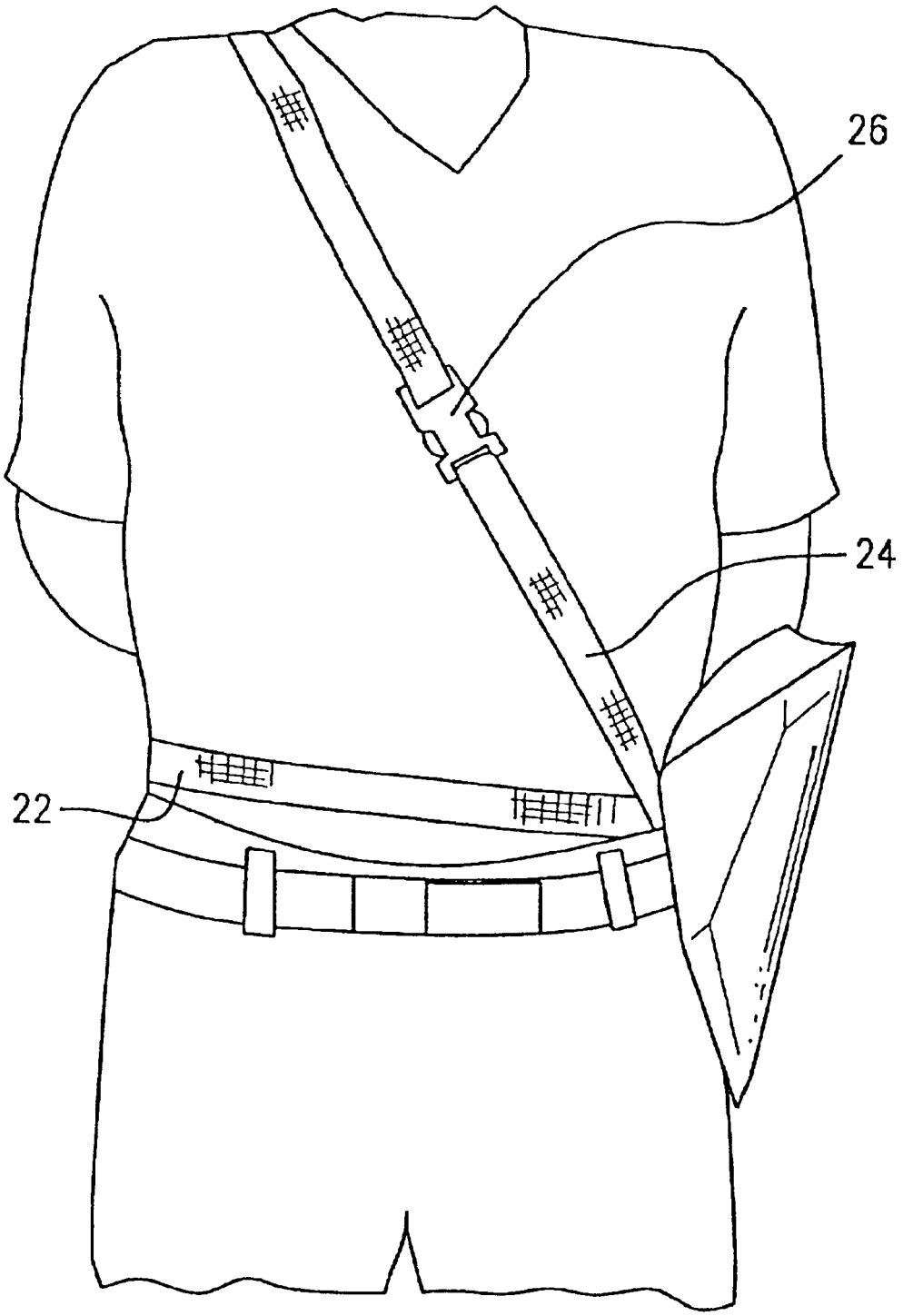
FIGS. 5 and 6 are views illustrating one manner of a parent's wearing the infant and small child carrier of the invention on his/her left hip, helpful in an understanding of the benefits afforded by the invention.
Figure 6:
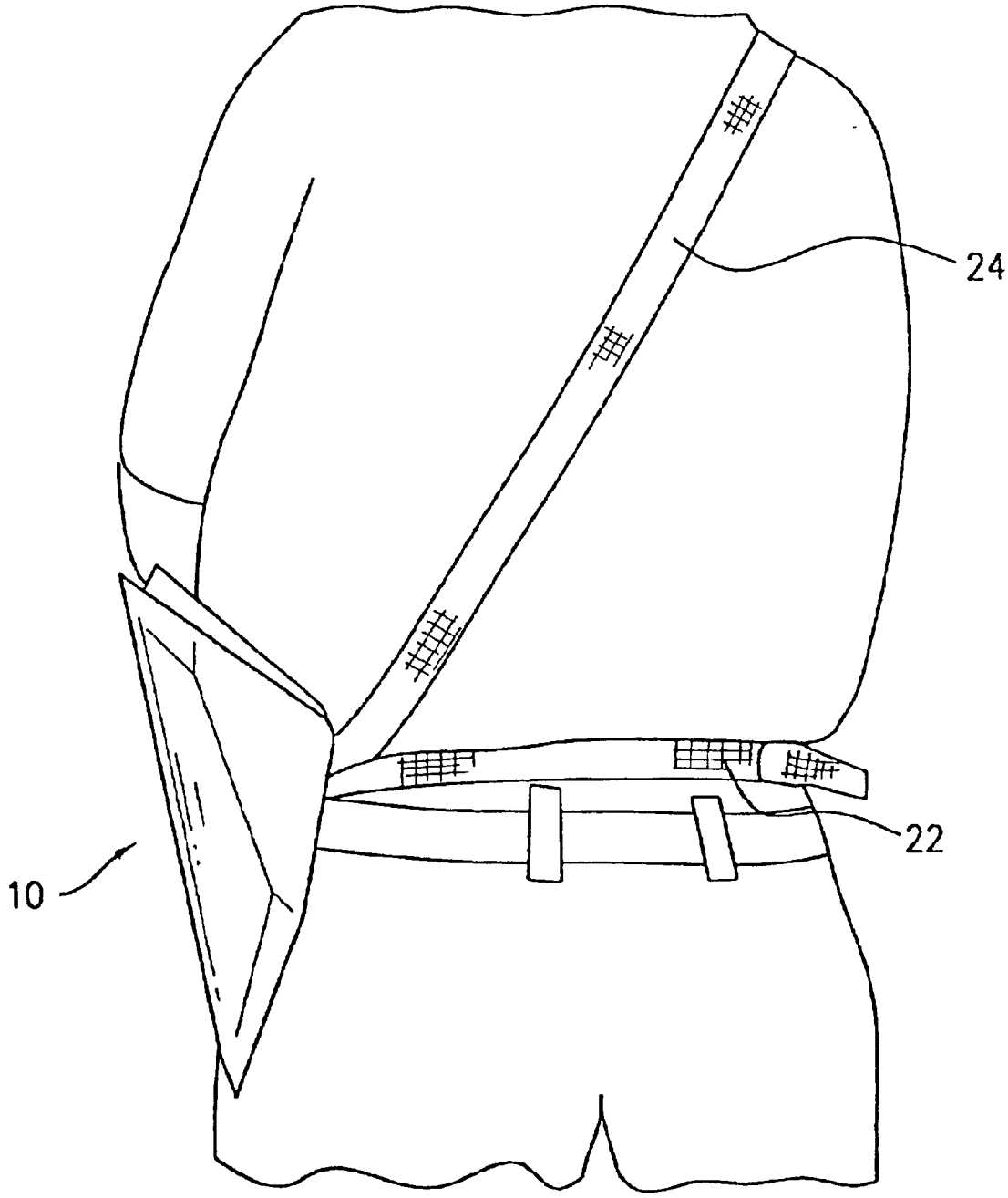

The "hip seat" infant and small child carrier of the invention shown in FIGS. 1–4 is in the nature of a seat 10 of substantially rigid material (such as plastic) to bear against the thigh of a wearer, as in FIGS. 5 and 6. Shown as having an open-bottom top 12, the seat includes an upwardly extending upper section 14, a downwardly extending lower section 16 and a pair of side sections 18–20 which join with the upper and lower sections 14, 16 as a single unit. When stored away and not worn, the seat rests on edge surfaces a, b, c, d of the upper, lower and side sections 14, 16, 18 and 20 respectively. A first strap 22 is shown as extending through the downwardly extending lower section to encircle the waist of the wearer, while a second strap 24 couples with the first strap 22 through the downwardly extending lower section 16 in extending across the chest, a shoulder, and the back of the wearer. A clasp or similar fastener 26 may be employed to secure the second strap and to adjust its length for comfortable snugness.

Figure 1:
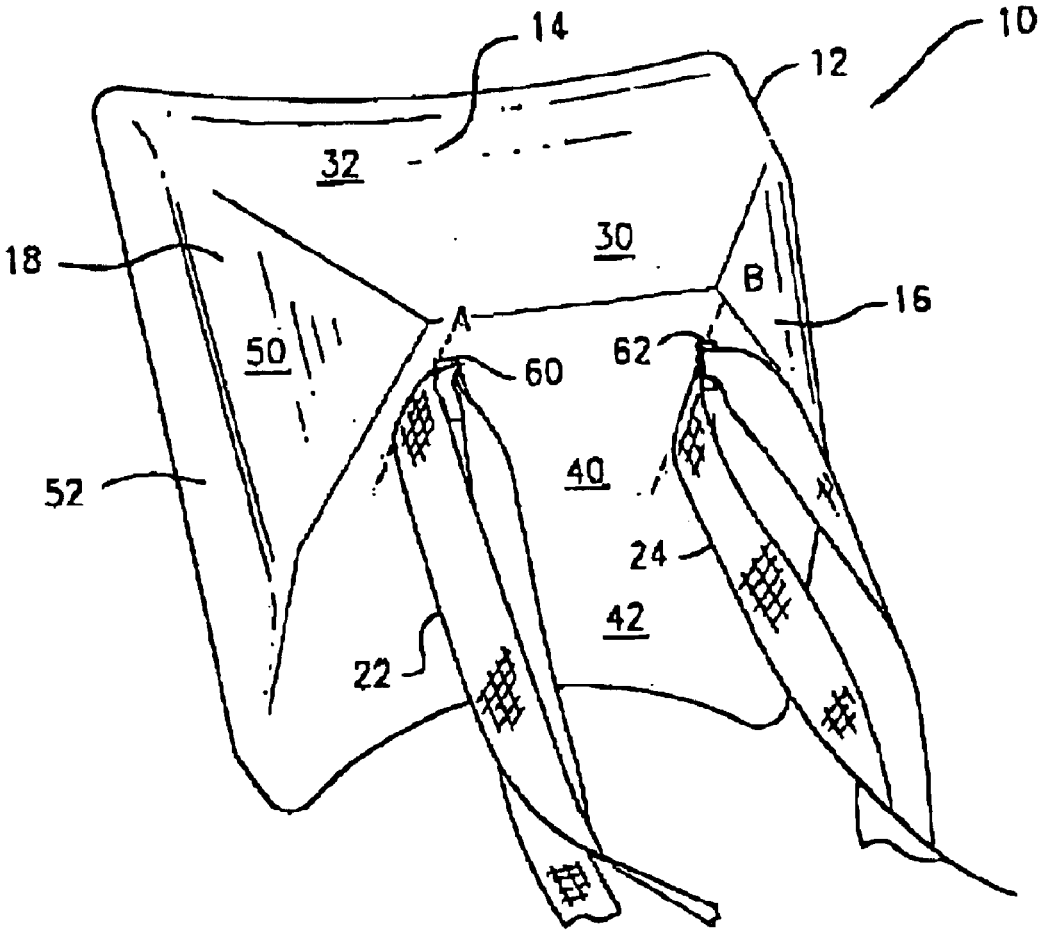
FIG. 1 is a top front perspective view of an infant and small child carrier constructed in accordance with a preferred embodiment of the invention.
Figure 2:
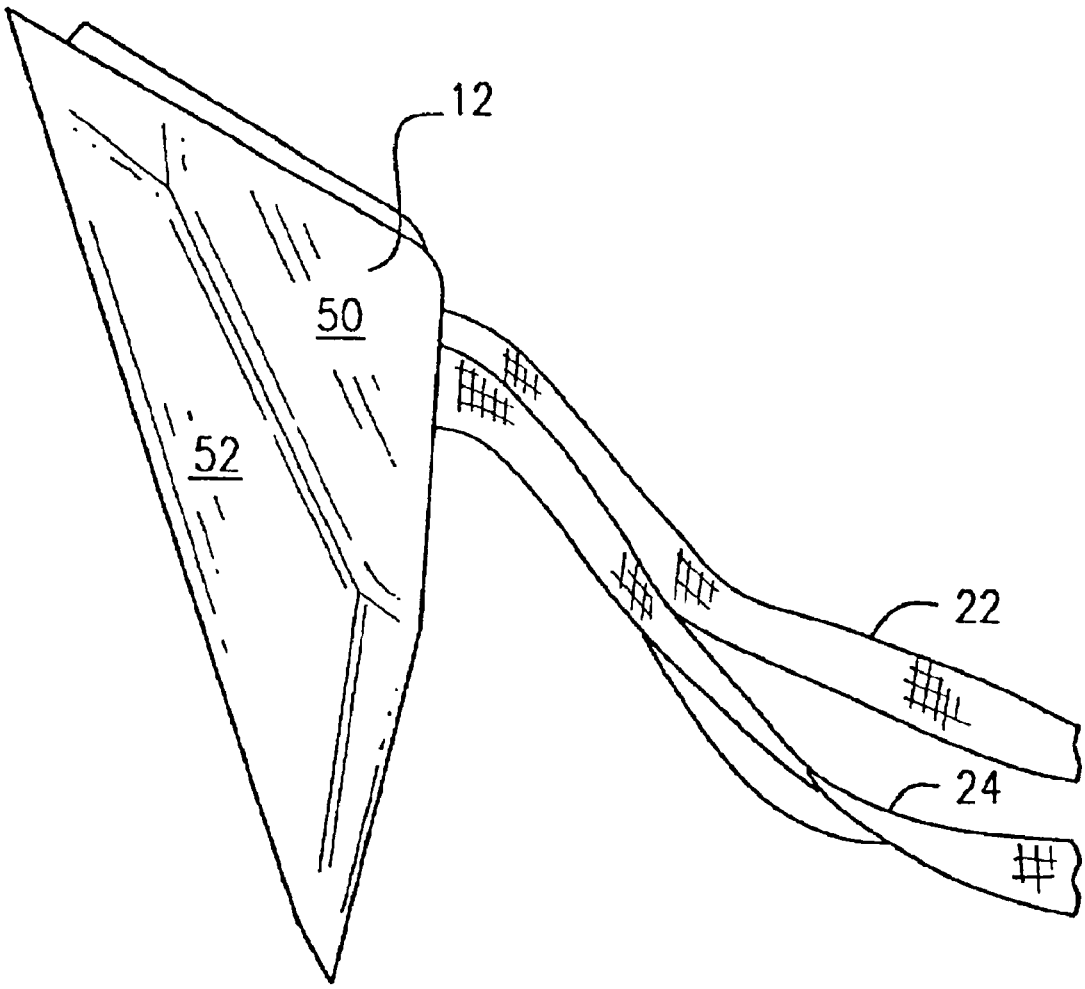
FIG. 2 is a left side perspective view of the infant and small child carrier of FIG. 1, a right side perspective view understood as being a mirror image thereof.
Figure 3:
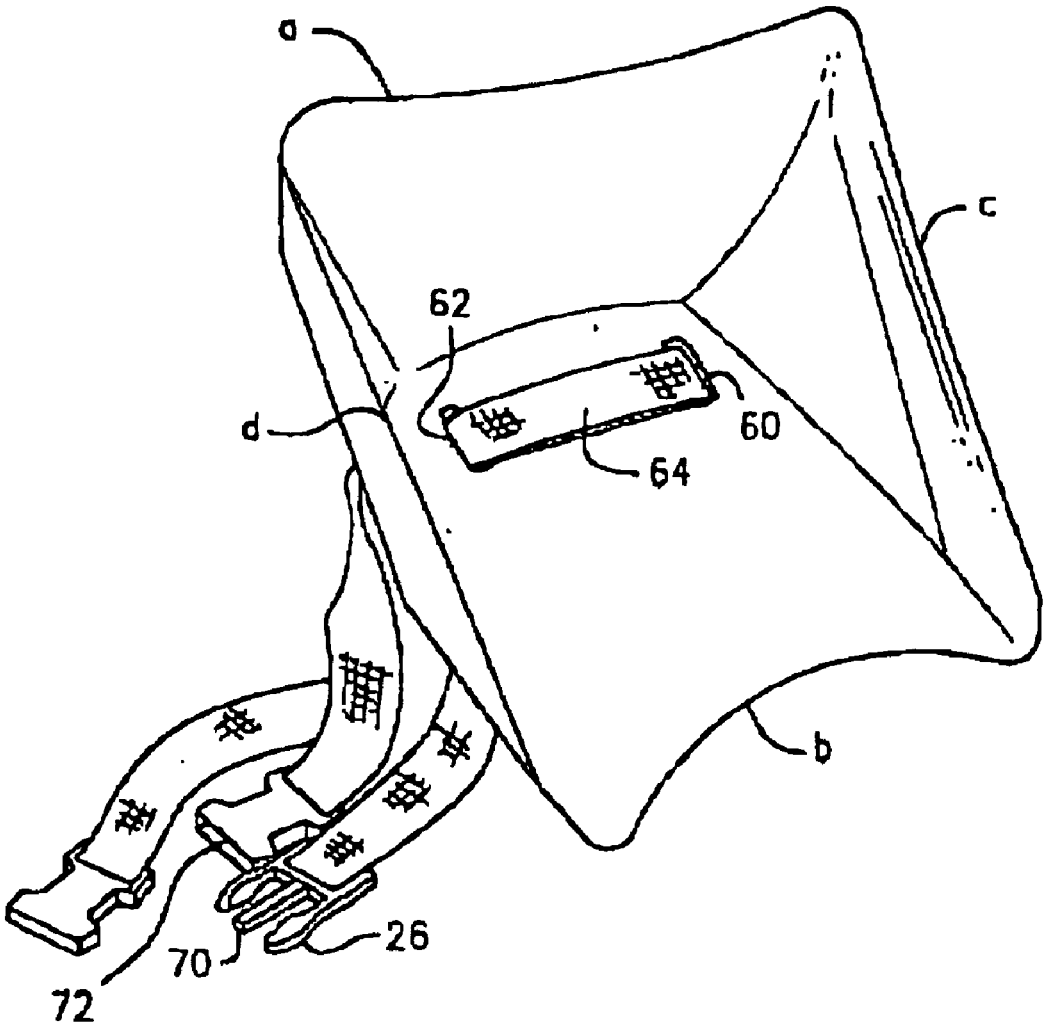
FIG. 3 is a top rear perspective view of the infant and small child carrier of the invention.
Figure 4:
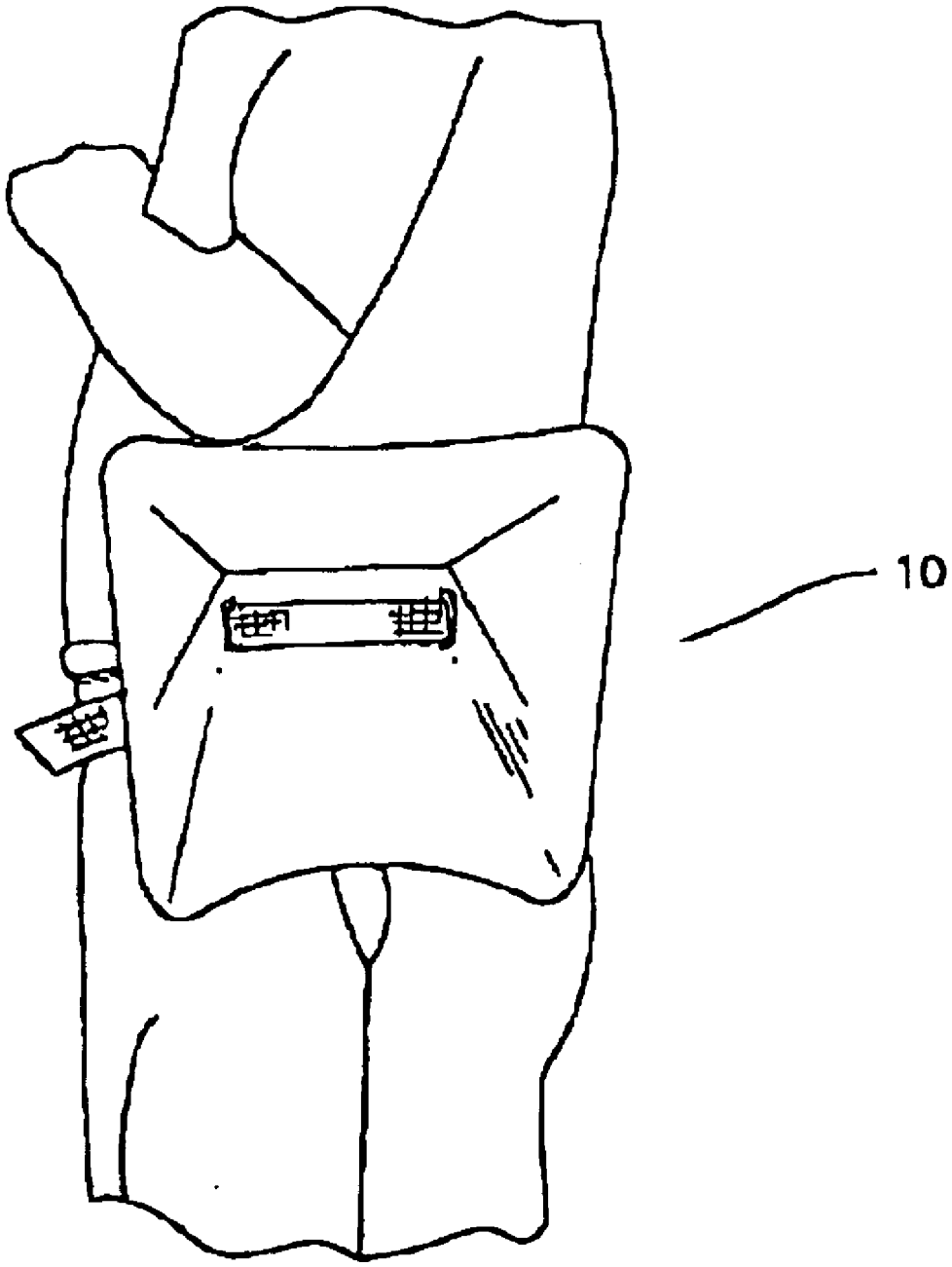
FIG. 4 is a rear view of the carrier of FIGS. 1–3.

As more clearly shown in FIGS. 1 and 2, the upwardly extending upper section 14 includes a first portion 30 of a first upwards angle and a second portion 32 contiguous therewith of a second lesser upwards angle with respect to it. As shown in FIGS. 2 and 3, the second portion 32 is additionally contoured curvilinearly downwards between the extremities of the second portion 32 remote from the first portion 30 of the upwardly extending upper section 14.

As FIGS. 1 and 3 also show, the downwardly extending lower section 16 includes a first portion 40 of a first downwards angle, and a second portion 42 contiguous therewith of a second, lesser downwards angle with respect to it. As shown in FIG. 3, the second portion 42 of the downwardly extending lower section 16 is similarly contoured curvilinearly, but upwards thereof between the extremities remote from the first portion 40 of the downwardly extending lower section 16.

Further, and as shown in FIGS. 1 and 2, each of the side sections 18, 20 include a first portion 50 of a first downwards angle and a second portion 52 contiguous with it of a second, lesser downwards angle.

The top of the seat 10 illustrated in FIGS. 1–4, then, essentially has upper, lower and side sections of two portions each, joined along the line between the points A and B, acting as a fulcrum in accordance with the invention, as more fully described below.

In those instances where it may be desired to soften the surfaces of the seat to the body of an infant or small child being carried (as well as to the parent using the seat), the seat 10 may include a fabric 97 covering the open-bottom top 12. Such fabric may be padded, if desired, and may be removable and washable as well. In those instances where it may be desired to utilize the seat for the carrying about of such items as diapers, creams, lotions, brushes, keys, etc., the fabric covering the open-bottom top 12 may further be extended across opposing ones of the edge surfaces a, b, c, d as 99, in forming a pocket enclosure, which may be selectively openable and closable for storage of this type—as by a Velcro closure, a zipper or other suitable means.

As FIGS. 1 and 2 show, the straps 22, 24 extend through slots 60, 62 cut within the first portion 40 of the downwardly extending lower section 16 of the seat 10, and are joined together at its underside by a further strap 64 coupling the straps 22, 24 together. FIG. 3 illustrates the clasp 26 as being of a conventional hasp and buckle arrangement 70, 72.

In accordance with a preferred embodiment of the invention, each of the first portions 30, 40 and 50 of the upper, lower and side sections are of a width $W_1$ greater than a corresponding width $W_2$ of the second portion 32, 42 and 52 of these three sections, respectively. Moreover, in this preferred embodiment, the widths $W_1$ of the first portions 30, 40 and 50 are each substantially equal—as are the widths $W_2$ of the second portions 32, 42 and 52. In similar fashion, in constructing this preferred embodiment, the first angles of the upwardly extending upper section 14, the downwardly extending lower section 16 and the pair of side sections 18, 20 are substantially equal—as are each of the second angles of the upwardly extending upper section 14, the downwardly extending lower section 16, and the pair of side sections 18, 20. In such respect, as so far described, an essentially symmetrical open-bottom top 12 is formed, symmetrical about any line that may be drawn between the points A and B. In accordance with a further feature of the invention, to provide even greater weight support for an infant or small child to be carried, the downwardly extending lower section 16 (composed of the portions 40, 42) is selected of a length $L_1$ greater than the length $L_2$ of the upwardly extending upper section 14 (formed of the portions 30, 32).

FIGS. 5 and 6 illustrate how the infant or small child can be carried on the seat 10, with the arm and hand of the parent holding it in place, without the need for its being strapped in. Specifically, the infant or child is placed on the upwardly extending upper section 14 facing in towards the body or away from it—the placement being in a direction such that the weight of the infant or small child is in a direction to rotate the downwardly extending lower section 16 against the thigh which then supports the weight. The contoured curvilinearity along the edge surface "a" allows the legs of the infant or child to comfortably extend over the upper section 14, while the contoured curvilinearity of the edge surface "b" spans across the thigh of the wearer in likewise offering a degree of comfort. As will be appreciated, the degree of comfort both to the child and to the parent wearing the carrier is enhanced all the more through the dividing of the upper section 14, the lower section 16 and the side sections 18, 20 into two portions each, along with the angulations there established. By lengthening the downwardly extending lower section 16 greater than the upwardly extending upper section 14, a larger bearing surface against the thigh is afforded, in opposing the moment produced through the weight of the infant or child. "Scooping-out" the upwardly extending upper section 14 to some degree can be employed further in accommodating the infant or child's "bottom" when being placed on the seat facing towards or away from the parent.

In use, all that the parent need do is to encircle the first strap 24 about the waist, extend the second strap 26 across the chest and over the shoulder slipping it down the back and clasping it in position, and then simply lifting the infant or small child on the open-bottom top 12. If need be, the infant or small child—being only held in place by the parent's arm and hand==can be easily placed down, and then picked back up into position. When the seat is to be taken off, the parent just unclasps the second strap 24 and removes it and the first strap 22. Obviously, the strap constructions 22, 24 can be positioned so as to encircle the waist and either shoulder of the parent (i.e., for support in wearing on the left hip or right hip), or could be positioned either as a "left-handed" or a "right-handed" model. In either event, the open-bottom top 12 of the invention can be easily molded, covered with fabric—padded or otherwise—enclosed as a pocket where desired, and made available for retail sale at prices not too very much different from those which typify conventional carriers and/or backpacks today. The ease of use and comparable pricing add to the desirability of the carrier, in addition to the increased support which characterizes the carrier.

While there have been described what are considered to be preferred embodiments of the present invention, it will be readily appreciated by those skilled in the art that modifications can be made without departing from the scope of the teachings herein. For at least such reason, therefore, resort should be had to the claims appended hereto for a true understanding of the scope of the invention.

I claim:

1. An infant and small child carrier comprising:

a seat of substantially rigid material to bear against the thigh of a wearer, said seat including:

a top having an upwardly extending upper section, a downwardly extending lower section, and a pair of side sections joining said upper and lower sections as a single unit;

a first strap through said lower section to encircle the waist of the wearer; and a second strap through said lower section coupled with said first strap to extend across the chest, a shoulder, and the back of the wearer;

wherein said upwardly extending upper section includes a first portion of a first upwards angle and a second portion contiguous therewith of a second, lesser upwards angle with respect thereto, wherein said downwardly extending lower section includes a first portion of a first downwards angle and a second portion contiguous therewith of a second, lesser downwards angle with respect thereto, and wherein each of said side sections include a first portion of a first downwards angle and a second portion contiguous therewith of a second, lesser downwards angle with respect thereto, and wherein each of said first portions of said upwardly extending upper section, said downwardly extending lower section and said pair of side sections are of a width greater than a corresponding width of said second portion of said upwardly extending upper section, said downwardly extending lower section, and said pair of side sections; and wherein said widths of said first portion of each of said upwardly extending upper section, said downwardly extending lower section, and said pair of side sections are substantially equal.

2. The carrier of claim 1 wherein said second portion of said upwardly extending upper section is contoured curvilinearly downwards thereof between extremities remote from said first portion of said upwardly extending upper section.

3. The carrier of claim 1 wherein said second portion of said downwardly extending lower section is contoured curvilinearly upwards thereof between extremities remote from said first portion of said downwardly extending lower section.

4. The carrier of claim 1 wherein said first and second straps extend through said first portion of said downwardly extending lower section.

5. The carrier of claim 1 wherein said widths of said second portions of said upwardly extending upper section, said downwardly extending lower section, and said pair of side sections are substantially equal.

6. The carrier of claim 1 wherein each of said first angles of said upwardly extending upper section, said downwardly extending lower section, and said pair of side sections are substantially equal.

7. The carrier of claim 1 wherein each of said second angles of said upwardly extending upper section, said downwardly extending lower section, and said pair of side sections are substantially equal.

8. The carrier of claim 1 wherein said downwardly extending lower section is of a length greater than the length of said upwardly extending upper section.

* * * * *